US012326088B2

(12) United States Patent
Franzoni et al.

(10) Patent No.: US 12,326,088 B2
(45) Date of Patent: Jun. 10, 2025

(54) VARIABLE DISPLACEMENT HYDRAULIC MOTOR

(71) Applicant: Dana Motion Systems Italia S.R.L., Reggio Emilia (IT)

(72) Inventors: Federica Franzoni, Reggio Emilia (IT); Fabio Natali, Modena (IT); Alessandro Sassi, Reggio Emilia (IT)

(73) Assignee: DANA MOTION SYSTEMS ITALIA S.R.L., Reggio Emilia (IT)

( * ) Notice: Subject to any disclaimer, the term of this patent is extended or adjusted under 35 U.S.C. 154(b) by 191 days.

(21) Appl. No.: 18/170,357

(22) Filed: Feb. 16, 2023

(65) Prior Publication Data

US 2024/0280020 A1 Aug. 22, 2024

(51) Int. Cl.

| | |
|---|---|
| ***F01B 3/02*** | (2006.01) |
| ***F01B 3/00*** | (2006.01) |
| ***F01B 3/10*** | (2006.01) |

(52) U.S. Cl.

CPC ..... *F01B 3/02* (2013.01); *F01B 3/0035* (2013.01); *F01B 3/0085* (2013.01); *F01B 3/103* (2013.01)

(58) Field of Classification Search

CPC ..... F01B 3/02; F01B 3/0035; F01B 3/0085; F01B 3/103

See application file for complete search history.

(56) References Cited

U.S. PATENT DOCUMENTS

| | | | | |
|---|---|---|---|---|
| 1,165,400 | A * | 12/1915 | Dreisbach | F04B 9/14 123/197.1 |
| 6,202,014 | B1 * | 3/2001 | Brandt | E02F 9/2029 172/263 |
| 6,840,696 | B1 * | 1/2005 | Donders | B23P 15/10 29/441.1 |
| 2012/0269656 | A1 | 10/2012 | Shimizu | |
| 2017/0276055 | A1 * | 9/2017 | Nabata | G11B 7/0903 |
| 2019/0112926 | A1 | 4/2019 | Hemink | |

* cited by examiner

*Primary Examiner* — Connor J Tremarche

(74) *Attorney, Agent, or Firm* — McCoy Russell LLP

(57) ABSTRACT

Systems and methods for a variable displacement hydraulic motor. The hydraulic motor, in one example, includes a swash plate with a tilt angle, multiple piston assemblies configured to rotate about a drive shaft. In the motor, each of the piston assemblies includes an inner piston slideably coupled to an outer piston that mates with a cylinder in a cylinder block and a retainer device configured to inhibit axial movement of the outer piston in a first position and permit axial movement of the outer piston in a second position.

20 Claims, 4 Drawing Sheets

VARIABLE DISPLACEMENT HYDRAULIC MOTOR

TECHNICAL FIELD

The present disclosure relates to a variable displacement motor and a method for hydraulic motor operation.

BACKGROUND AND SUMMARY

Previous variable displacement motors have relied on variable angle swash plates to alter motor displacement. These motors have included a drive shaft connected to a cylinder block which contains pistons. The pistons interact with a swash plate that is angled relative to the piston block to drive reciprocating motion of the pistons in the cylinders. The swash plate's angle is adjusted to alter the displacement of the motor. Consequently, the motor's displacement can be adapted to match the working conditions of the system in which is it deployed and increase motor efficiency, for instance. Certain motors have utilized bushing to allow for angular adjustment of the swash plate.

US 2019/0112926 A1 to Hemink discloses an axial piston machine (e.g., a pump or a motor) which, in one embodiment, has adjustable displacement functionality. To alter the machine's displacement, the swash plate is rotated using a variable displacement assembly to alter the reciprocal displacement of the piston. The variable displacement assembly includes a swash collar and a piston and spring assembly designed to control tilt of a wobble plate coupled to a swash collar.

The inventors have recognized several issues with Hemink's machine as well as other previous variable displacement motors and pumps. For instance, Hemink's variable displacement assembly may be prone to wear and ultimately degradation. Consequently, the machine's longevity is decreased, thereby demanding smaller service intervals. Other motors and pumps have utilized bushings that may similarly be susceptible to wear and degradation, impacting the device's reliability.

Facing the abovementioned issues, the inventors developed a variable displacement hydraulic motor to overcome at least a portion of the issues. In one example, the hydraulic motor includes a swash plate with a tilt angle (e.g., a fixed tilt angle). The hydraulic motor further includes multiple piston assemblies configured to rotate about a drive shaft. Each of the piston assemblies includes an inner piston slideably coupled to an outer piston that mates with a cylinder in a cylinder block and a retainer device configured to inhibit axial movement of the outer piston in a first position and permit axial movement of the outer piston in a second position. In this way, the motor's displacement can be reliably altered using a piston in piston assembly, that is less prone to wear and degradation than previous variable displacement mechanisms. As a result, the motor's longevity and custom appeal is increased. Further, the motor with the retainer devices is able to achieve less complexity than variable angle swash plate machines. Further, the hydraulic motor described above allows the motor to achieve higher efficiency when compared to adjustable swash plate motors that when operating in a reduced swash plate angle mode, experience decreased efficiency. Further, using the retainer devices to adjust the motor's displacement as opposed to variable angle swash plates, allows the motor's axial length to be reduced, if desired.

Further, in one example, the retainer device may include a pin which may be radially aligned. The pin may be hydraulically actuated such that the pin extends and retracts based on hydraulic line pressure. Extension of the pin axially delimits movement of the outer piston and retraction of the pin allows both the outer and inner pistons to axially reciprocate in unison. In this way, the retainer device may reliably alter the displacement of the motor. Consequently, the motor may be more efficiently operated over a wide range of operating conditions using a mechanism that is less prone to wear and ultimately operational degradation.

In another example, the retainer device may include an axially displaceable body that includes a radial extension that axially delimits the outer piston in a retracted position and permits reciprocal movement of the outer piston in an extended position. In this way, the retainer device is configured for axial actuation, enabling the device to be space efficiently incorporated into the motor's housing, if desired.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

A variable displacement hydraulic motor that achieves greater reliability and efficiency as well as reduced complexity over motors using adjustable angle swash plates is described herein. To achieve the increased reliability and efficiency, the motor is provided with piston assemblies that each have inner and outer pistons. The axial movement of the outer piston is activated and deactivated to switch the motor between a reduced displacement configuration and a full displacement configuration. To achieve this motor displacement alteration functionality, the motor includes a retainer device (e.g., a hydraulic retainer device), that may take the form of a hydraulically actuated pin which extends and retracts in a radial direction. In the extend position the pin, axially delimits movement of the outer piston, and in the retracted position, both the inner and outer pistons axially reciprocate in tandem. In other examples, the retainer device may include an axially translatable body that includes an extension which axially delimits the outer piston in the partial displacement configuration. In this way, the displacement of the motor may be reliably altered. The swash plate may have fixed position in one example. In this way, the reliability of the motor may be further increased and the complexity may be further reduced when compared to previous adjustable displacement machines. Further, using the retainer devices to vary the motor's displacement allows the axial length of the motor to be reduced when compared to motors using adjustable angle swash plates, if desired.

Figure 1A:
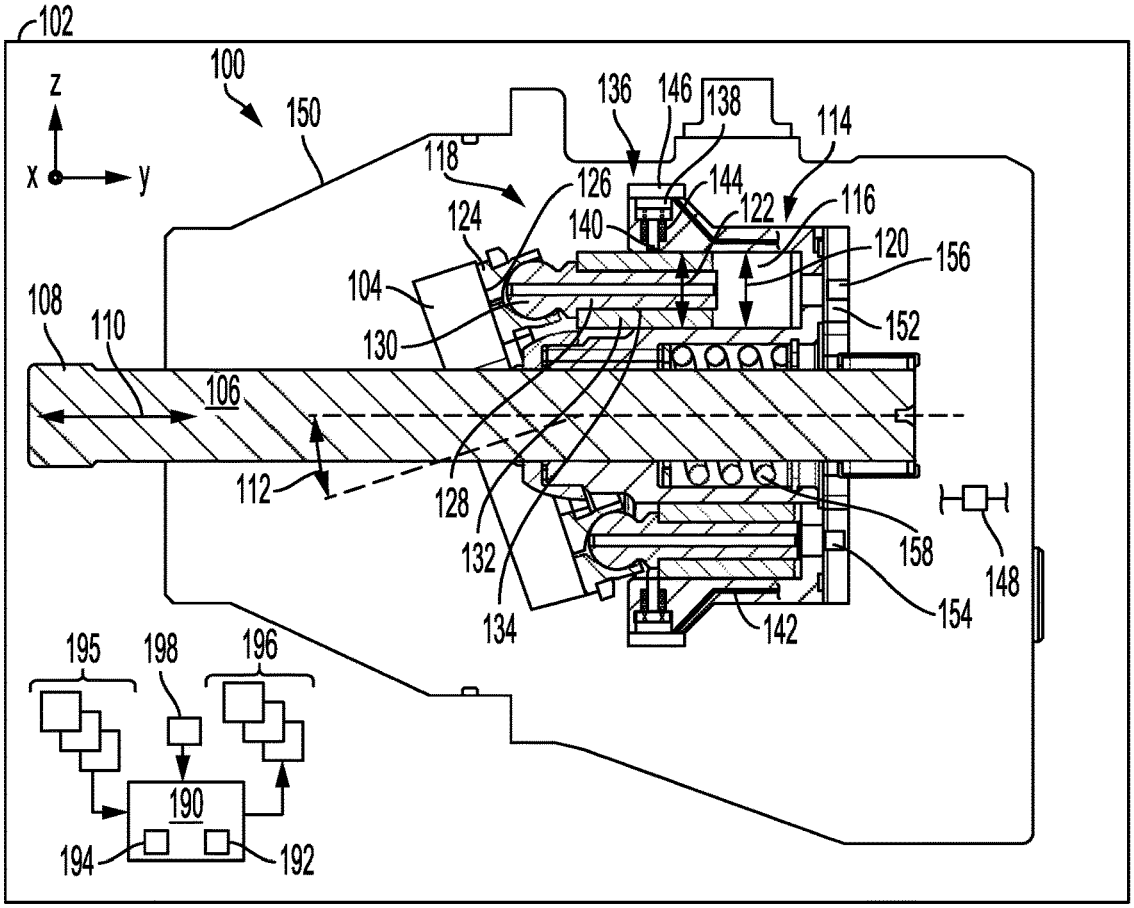
FIGS. 1A and 1B show a first example of a variable displacement hydraulic motor in a system.
Figure 1B:
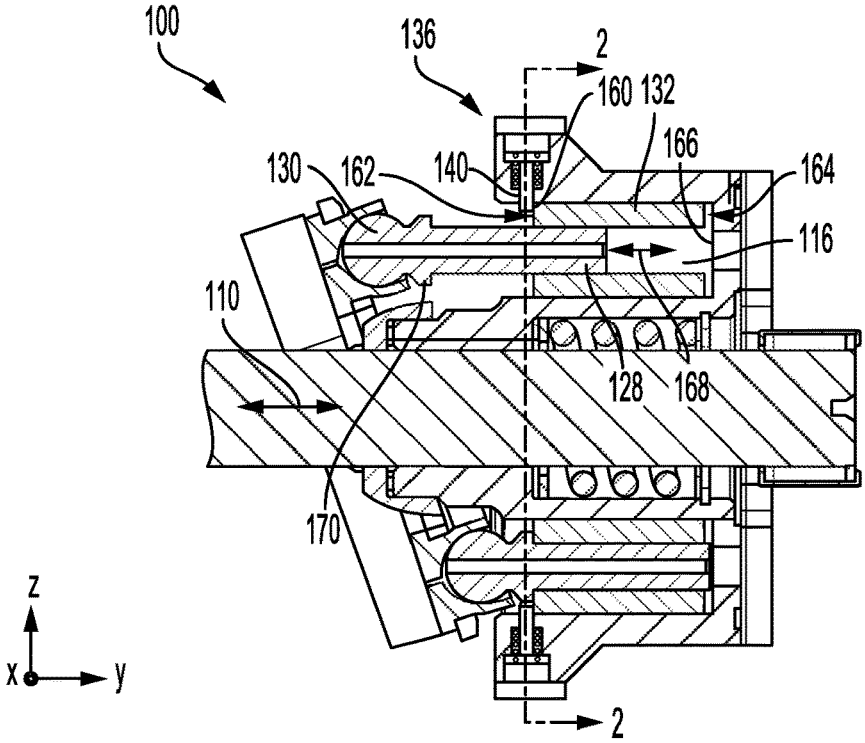
Figure 2:
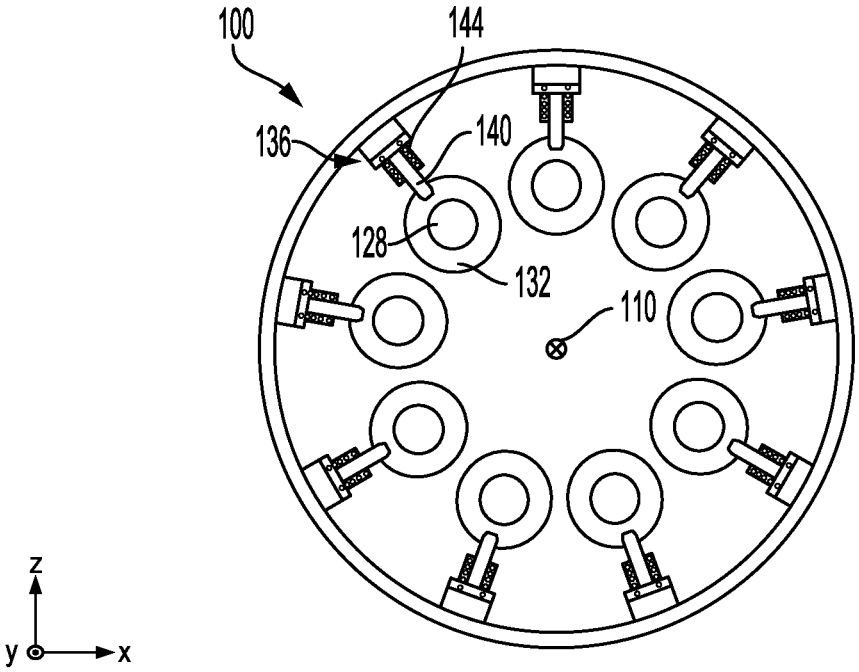
FIG. 2 shows a cross-sectional view of the hydraulic motor, depicted in FIG. 1B.
Figure 4A:
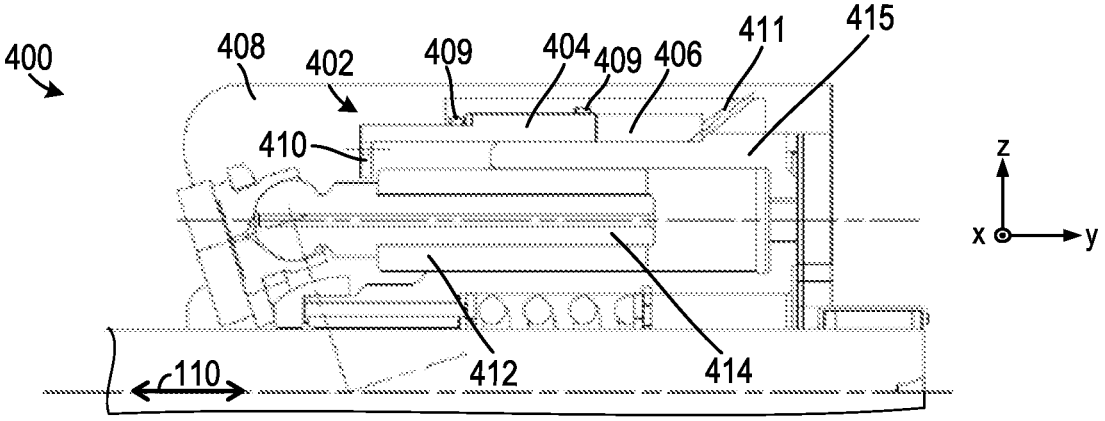
FIGS. 4A and 4B show a third example of a variable displacement hydraulic motor.
Figure 4B:
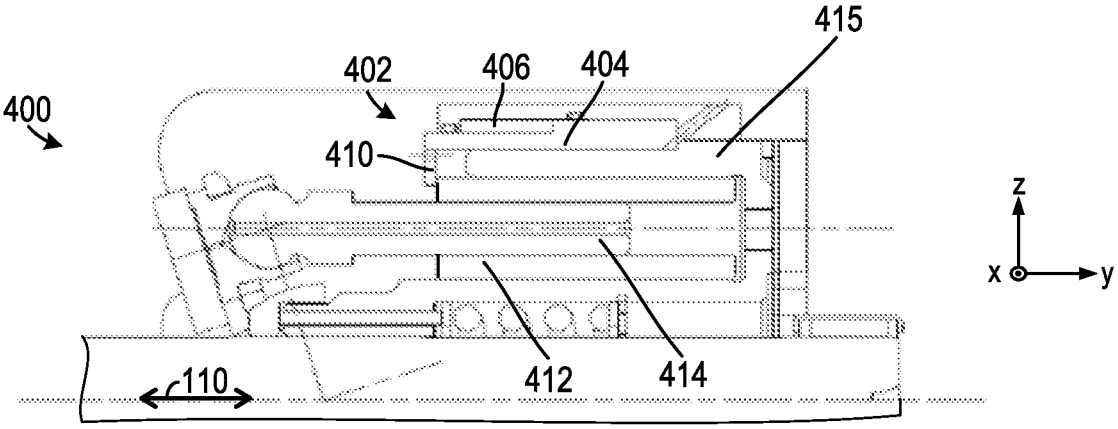
Figure 3A:
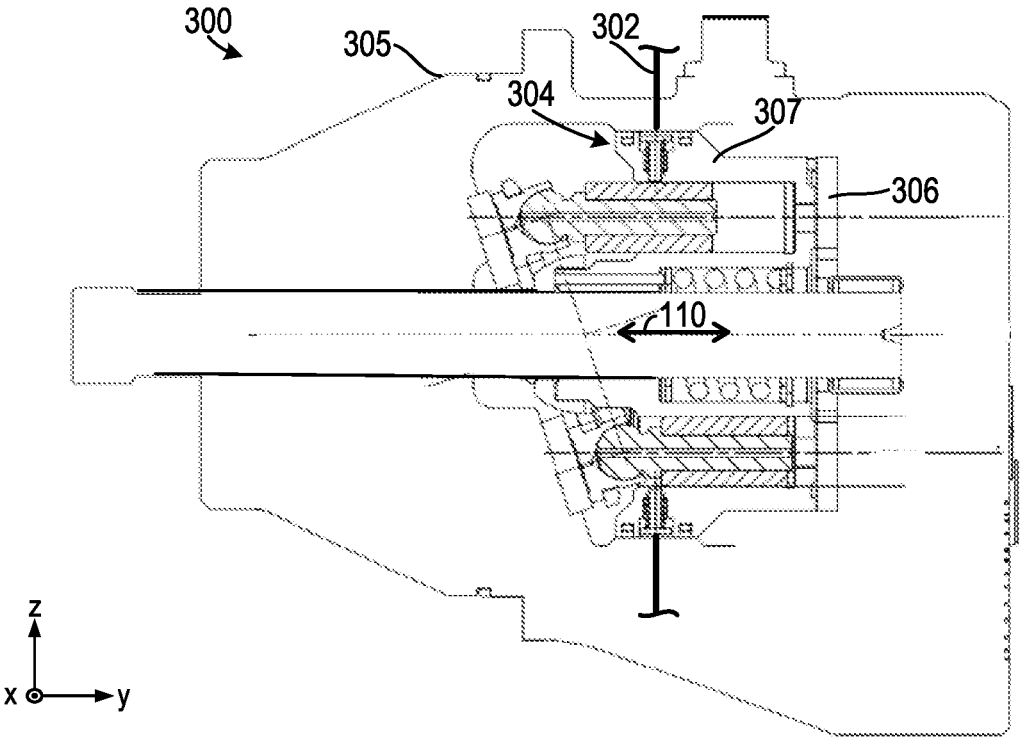
FIGS. 3A and 3B show a second example of a variable displacement hydraulic motor.
Figure 3B:
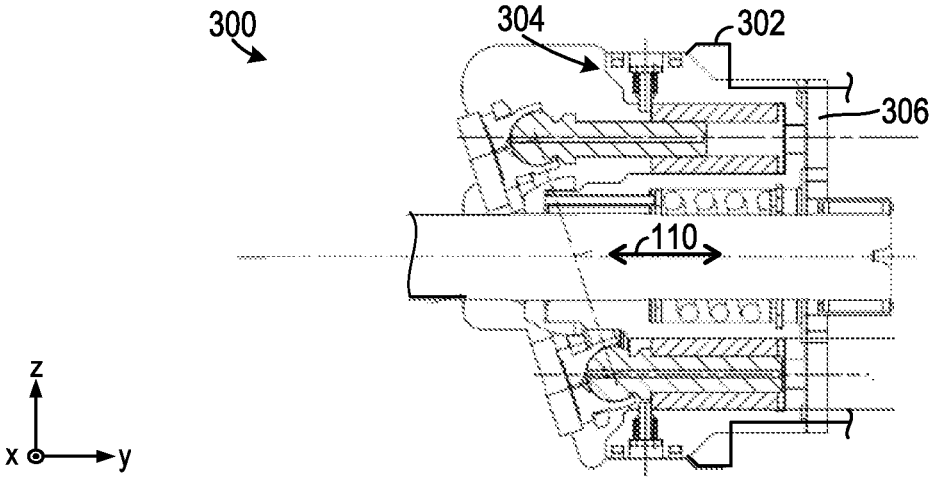
Figure 5:
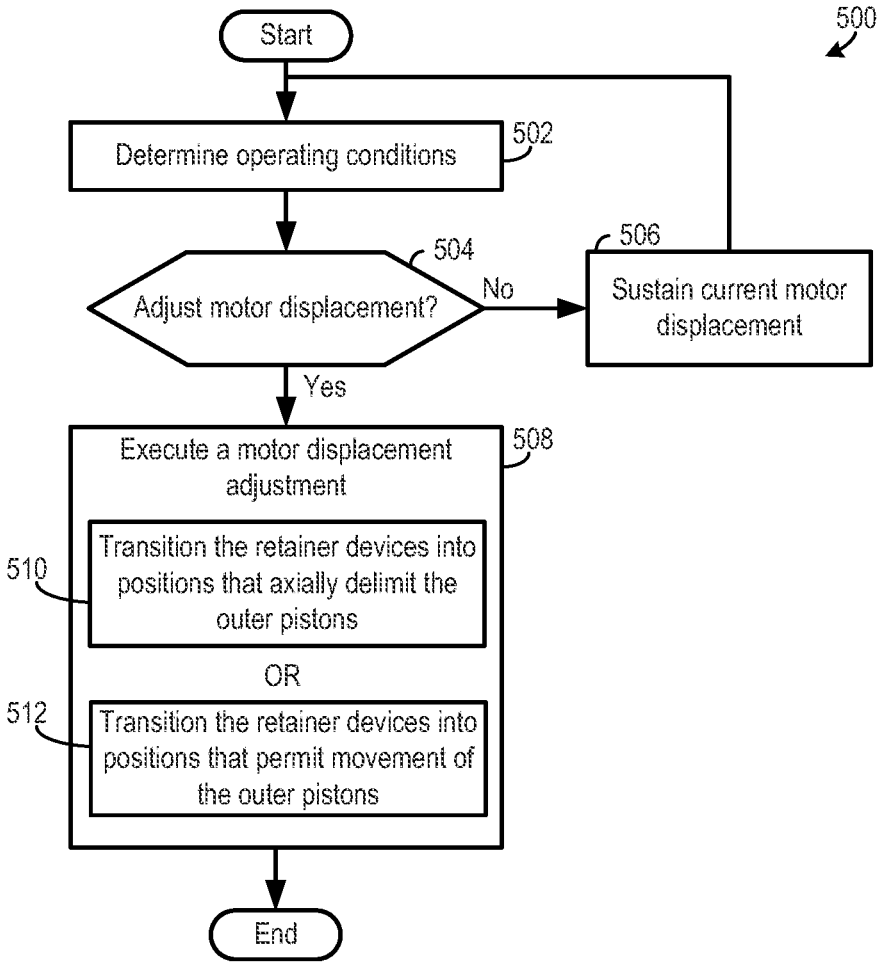
FIG. 5 shows a method for operation of a variable displacement hydraulic motor.

FIGS. 1A and 1B show a first example of a variable displacement hydraulic motor in a full displacement configuration and a partial displacement configuration dictated by pin retainer devices. FIG. 2 shows a cross-sectional view of the hydraulic motor depicted in FIG. 1B, in the partial displacement configuration where the pins is extended and axially delimiting movement of outer pistons. FIGS. 3A and 3B show another example of a variable displacement hydraulic motor, with a different hydraulic routing for the retainer devices that facilitate motor displacement adjustment. FIGS. 4A and 4B show yet another example of a variable displacement hydraulic motor with a retainer device that includes an axially translatable body and an extension that again selectively axially constrains movement of the outer piston. FIG. 5 shows a method for adjusting the displacement of a hydraulic motor.

FIG. 1A shows a variable displacement hydraulic motor 100 (e.g., multi-speed hydraulic motor) in a system 102. The motor 100 may be deployed in a variety of system including but not limited to a transmission (e.g., a hydromechanical transmission), industrial systems, and the like.

The variable displacement hydraulic motor 100 includes a swash plate 104 and a drive shaft 106 with an input interface 108. Bearings (e.g., ball bearings, roller bearings, tapered roller bearings, and the like) may be coupled to the drive shaft 106 and enable rotation and support of the drive shaft. The input interface 108 functions as a mechanical coupling for upstream components. For instance, the input interface 108 may be coupled to a mechanical branch in a hydromechanical transmission, in one use-case example. However, the motor 100 may be rotationally coupled to a variety of suitable components, in other examples.

The drive shaft 106 rotates about axis 110 during motor operation. Axis 110 is additionally shown in FIG. 1B as well as FIGS. 2, 3A, 3B, 4A, and 4B, for reference. Further, the swash plate 104 is arranged at a tilt angle 112 with regard to the axis 110. In the illustrated example, the tilt angle 112 is fixed. In one example, the tilt angle may be between 16 and 20 degrees and specifically may be 18 degrees, in one use-case example. Thus, the swash plate tilt angle remains constant throughout various modes of operation of the motor. Using a fixed angle swash plate allows the reliability of the motor to be increased when compared to motors which deploy bushings and/or other components which are prone to degradation to vary the angle of the swash plate. As a result, the motor's longevity is increased. However, other suitable tilt angles may be used, in other examples.

The motor 100 further includes a cylinder block 114 with multiple cylinders 116. Piston assemblies 118 are designed to axially reciprocate within the cylinders and mate therewith. Thus, each of the cylinders 116 has a greater inner diameter 120 than the outer diameter 122 of the associated piston assemblies 118.

The piston assemblies 118 are rotationally coupled to the drive shaft 106 and therefore rotate responsive to drive shaft rotation. The piston assemblies 118 include slippers 124 that are in face sharing contact with a surface 126 of the swash plate 104. The slippers 124 are attached to inner pistons 128 via joints 130 (e.g., ball joints). The piston assemblies 118 further include outer pistons 132. Each outer piston circumferentially encloses the corresponding the inner piston and mates therewith. Thus, the outer pistons are annular in cross-section and include central openings. The sizes of the inner and outer pistons may be selected, prior to manufacturing, based on partial displacement and full displacement target values. For instance, the geometric area of the inner and outer pistons may be selected based on the pump's expected end-use operating environment.

Interfaces 134 are formed between the inner pistons 128 and the outer pistons 132. The material(s) used to construct the inner and outer pistons may be selected based on tradeoffs between the two operating conditions of the pistons ((i) reciprocating in unison and (ii) reciprocating the inner piston within the outer piston while the outer piston's axial movement is constrained (e.g., inhibited)). For instance, a reduced amount of friction between the inner and outer pistons may be desirable when the outer piston is axially delimited. However, increased friction may be desired when the pistons move in unison. In one example, the inner and outer pistons may be constructed out of nitride steel to reduce friction and increase mechanical characteristics. However, the pistons may be constructed out of additional or alternative suitable materials, in other examples.

In the partial displacement mode, the inner pistons 128 axial reciprocate independently from the outer pistons 132 which are axial delimited. The axial constraint of the outer pistons 132 is expanded upon herein. Conversely, in a full displacement mode, the inner and outer pistons 128, 132 axially reciprocate within the cylinders in unison.

The hydraulic motor 100 further includes retainer devices 136 corresponding to each piston assembly. In the illustrated example, the retainer devices 136 are hydraulically actuated pin devices 138 that extend and retract (e.g., radially extend and retract) pins 140 based on fluid pressure (e.g., oil pressure) in the hydraulic lines 142. The working fluid in the hydraulic motor may be oil (e.g., natural or synthetic oil). The pins 140 may be radially aligned to enable the outer pistons to be confidently retained.

The pin devices 138 include the pins 140, a spring 144, and an actuation chamber 146. The pins 140 are shown in a retracted position such that they do not interact with the outer pistons 132 to axially delimit the pistons.

Using the retainer devices and piston assemblies to alter the motor's displacement enable the motor to achieve greater efficiency and less complexity when compared to variable angle swash plate machines. Further, using the retainer devices and piston assemblies further allows the axial length of the motor to be reduced, if desired, when compared to machines with adjustable angle swash plates.

In the illustrated example, the hydraulic lines 142 are routed through the cylinder block 114, and the valve plate 152, in some examples. To elaborate, multiple ducts may be used to route fluid to the retainer devices 136. At least a portion of these ducts may pressurized in one example, or non-pressurized, in another example. This internal hydraulic line routing may demand hydrostatic balance on the valve plate due to the hydraulic lines potentially solely allowing passage of fluid during certain conditions. Routing the hydraulic lines in this manner allow the dimensioning of the motor to be relatively unaffected, if desired, but may demand increased manufacturing complexity. However, in other examples, the hydraulic lines may be routed to the retainer devices via the housing.

One or more valves 148 may be coupled to the hydraulic lines 142 to allows the pressure in the hydraulic lines to be adjusted. Further, a pump and/or other hydraulic circuitry may be in fluidic communication with the valves.

In the illustrated example, the hydraulic motor 100 further includes a housing 150 and a valve plate 152. The valve plate 152 may include inlet valves 154 and outlet valves 156 (schematically depicted in FIG. 1A) which may be hydraulically coupled to upstream and downstream system components, respectively. The hydraulic motor 100 may further include a block spring 158.

The hydraulic motor 100 is illustrated as a two speed motor. However, in alternate examples, the motor may be designed with three or more speeds. In these examples, additional inner pistons may be added to the piston assembly to enable greater displacement tuning granularity.

The system 102 may further include a controller 190 (e.g., transmission control unit (TCU)), as shown in FIG. 1A. The controller 190 may include a microcomputer with components such as a processor 192 (e.g., a microprocessor unit), input/output ports, an electronic storage medium 194 for executable programs and calibration values (e.g., a read-only memory chip, random access memory, keep alive memory, a data bus, and the like). The storage medium may be programmed with computer readable data representing instructions that are executable by the processor for performing the methods and control techniques described herein as well as other variants that are anticipated but not specifically listed. As such, control techniques, methods, and the like expanded upon herein may be stored as instructions in non-transitory memory.

The controller 190 may receive various signals from sensors 195 coupled to various regions of the system 102. For example, the sensors 195 may include a pedal position sensor designed to detect a depression of an operator-actuated pedal such as an accelerator pedal and/or a brake pedal, speed sensor(s) at the transmission input and/or output shaft, clutch position sensors, and the like. An input device 198 (e.g., accelerator pedal, brake pedal, drive mode selector, gear selector, combinations thereof, and the like) may further provide input signals indicative of an operator's intent for system control.

Upon receiving the signals from the various sensors 195 of FIG. 1A, the controller 190 processes the received signals, and employs various actuators 196 of system components to adjust the components based on the received signals and instructions stored on the memory of controller 190. For example, the controller 190 may be designed to alter the displacement of the hydraulic motor 100. For instance, when the controller 190 determines that the displacement of the motor should be adjusted either via operator input and/or based on system operating conditions. In response to this determination, the controller 190 may adjust the valve 148, pump, and/or other hydraulic adjustment apparatus coupled to the lines 142 to alter the pressure in the line to adjust the state of the retainer devices 136. For instance, the pressure in the hydraulic lines 142 may be increased to extend the pins 140 and decreased to retract the pins. However, in other examples, the retainer device may be electromechanically actuated via a solenoid actuator. The other controllable components in the system may function in a similar manner with regard to sensor signals, control commands, and actuator adjustment, for example.

An axis system is provided in FIG. 1A as well as FIGS. 1B, 2, 3A, 3B, 4A, and 4B, for reference. The z-axis may be a vertical axis (e.g., parallel to a gravitational axis), the x-axis may be a lateral axis (e.g., horizontal axis), and/or the y-axis may be a longitudinal axis, in one example. However, the axes may have other orientations, in other examples.

In the hydraulic motor configuration shown in FIG. 1A, both the inner and outer pistons 128, 132 reciprocate in the cylinders in unison during motor operation. This configuration may be referred to as a full displacement configuration, where the pistons displace a greater amount of fluid than the partial displacement configuration, expanded upon herein.

FIG. 1B shows the hydraulic motor 100 in a partial displacement configuration where the pins 140 in the retainer devices 136 are extended into the cylinders 116 such that the axially delimit (e.g., inhibit) movement of the outer pistons 132. Thus, side surfaces 160 of the pins 140 are in contact with or adjacent to axial ends 162 of the outer cylinders. Further, in the partial displacement configuration, the axial ends 164 of the outer pistons 132 are adjacent to end walls 166 of the cylinders. In this way, the inner pistons 128 reciprocate within the outer pistons which are held substantially axially stationary. Arrows 168 indicate the reciprocal movement of the inner pistons 128. As shown, the axial length of the pins 140 are selected to avoid contact with a flange 170 of the inner pistons 128, near the joints 130. Cutting plane 2-2, shown in FIG. 1B denotes the cross-sectional view depicted in FIG. 2.

FIG. 2 shows a cross-sectional view of the variable displacement hydraulic motor 100. The inner pistons 128 and the outer pistons 132 in the piston assemblies 118 are again shown along with the retainer devices 136 with the pins 140 in their extended position which block axial movement of the outer pistons 132. The springs 144 in the retainer devices 136 are further depicted in FIG. 2.

FIGS. 3A and 3B show another example of a variable displacement hydraulic motor 300 in a full displacement configuration and a partial displacement configuration, respectively. The hydraulic motor 300 includes several structural and functional features that overlap with the hydraulic motor 100, shown in FIGS. 1A and 1B. Therefore, redundant of these shared features is omitted for brevity.

FIGS. 3A and 3B specifically show hydraulic lines 302 that provide hydraulic actuation for retainer devices 304 routed through the housing 305. To elaborate, the hydraulic lines 302 may feed the retainer devices 304 (e.g., the control pins) for the outer pistons via contact (e.g., a hydraulic interface) between the housing 305 and the cylinder block 307. However, as previously discussed, the hydraulic lines may be routed internally through the cylinder block and/or the valve plate 306.

FIGS. 4A and 4B show another example of a variable displacement hydraulic motor 400 in a full displacement configuration and a partial displacement configuration. The hydraulic motor 400 includes many structural and functional features that overlap with the hydraulic motor 100, shown in FIGS. 1A and 1B. Therefore, redundant of these shared features is omitted for brevity.

The retainer devices 402 shown in FIGS. 4A and 4B include a body 404 that is designed to axially translate within a chamber 406 in the housing 408. Seals 409 are provided at the interface of the chamber 406 and the body 404 to enable fluid to be contained in the chamber and pressurized to allow for device actuation. Further, hydraulic lines 411 extend through the housing and open into the chamber to enable hydraulic actuation of the retainer devices. Valves, a pump, and the like may be coupled to the hydraulic lines to enable hydraulic actuation of the retainer devices.

An extension 410 is coupled to the end of the body 404 that functions to axially delimit the outer piston 412 when the body 404 is in the axially retracted position shown in FIG. 4A. The extension 410 may be radially aligned and arranged substantially perpendicular to the body 404, in one example. Conversely, when the body 404 is in the extended position shown in FIG. 4B, the outer piston 412 can move in unison with the inner piston 414 when the motor is in operation. In this way, a different mechanism may be provided for retaining the outer piston to adjust motor displacement. The geometry of the displacement adjustment mechanism in FIGS. 4A and 4B anchors the outer pistons using retainer devices which can be external to the cylinder block 415. Further, these retainer devices can be hydraulically fed both from lines routed through the cylinder block or lines routed from the housing to the cylinder block, in different examples. In one specific example, a single pressurized line may be used to feed each of the retainer devices, thereby simplifying the system's design and therefore manufacturing.

FIG. 5 shows a method 500 for operation of a variable displacement hydraulic motor. The method 500 may be carried out by any of the hydraulic motors or combinations of the motors described herein with regard to FIGS. 1A-4B, in one example. In other examples, the methods may be implemented by other suitable variable displacement hydraulic motors. Furthermore, the method 500 may be implemented by a controller that includes memory holding instructions for the method steps that are executable by a processor, as previously indicated.

The method 500 illustrated in FIG. 5 includes at 502, determining operating conditions. The operating conditions may include input device position (e.g., gearshift lever position), clutch configuration, accelerator pedal position, transmission input/output speed, motor speed, vehicle speed, vehicle load, ambient temperature, and the like. The operating conditions may be ascertained via sensor inputs, modeling, look-up tables, and/or other suitable techniques.

Next at 504, the method includes judging if the motor's displacement should be adjusted. This judgement may take into account system operating conditions, such as motor efficiency, target motor output oil flow, and the like. For instance, the motor's displacement may be adjusted when the motor's efficiency drops below or rises above a threshold value. However, other techniques for determining when to switch the motor's displacement have been contemplated.

If it is determined that the motor's displacement should not be adjusted (NO at 504) the method moves to 506 where the method includes sustaining the motor's current displacement. For instance, the motor may be maintained in a full displacement configuration or a partial displacement configuration.

Conversely, if it is determined that the motor's displacement should be adjusted (YES at 504) the method moves to 508 where the method includes executing a motor displacement adjustment which may include step 510 or step 512. At 510, the method includes transitioning the retainer devices into positions that axially delimit the outer pistons. Conversely, at 512 the method includes transitioning the retainer devices into positions that permit movement of the outer pistons.

The technical effect of the hydraulic motor operating methods described herein is to increase motor reliability while achieving displacement adjustment functionality. In this way, the motor's displacement may be adjusted to more aptly suit operating conditions using a mechanism that is less susceptible to degradation than previous displacement adjustment mechanisms.

FIGS. 1A, 1B, 2, 3A, 3B, 4A, and 4B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Additionally, elements co-axial with one another may be referred to as such, in one example. Further, elements shown intersecting one another may be referred to as intersecting elements or intersecting one another, in at least one example. Further still, an element shown within another element or shown outside of another element may be referred as such, in one example. In other examples, elements offset from one another may be referred to as such. Even further, elements which are coaxial or parallel to one another may be referred to as such. Still further, an axis about which a component rotates may be referred to as a rotational axis.

The invention will be further described in the following paragraphs. In one aspect, a variable displacement hydraulic motor is provided that comprises a swash plate with a tilt angle; a plurality of piston assemblies configured to rotate about a drive shaft; wherein each of the plurality of piston assemblies includes: an inner piston slideably coupled to an outer piston that mates with a cylinder in a cylinder block; and a retainer device configured to inhibit axial movement of the outer piston in a first position and permit axial movement of the outer piston in a second position.

In another aspect, a method for operation of a variable displacement hydraulic motor is provided that comprises selectively adjusting a displacement of the variable displacement hydraulic motor via adjustment of a hydraulic retainer device; wherein the hydraulic retainer device is configured to: in a first position, delimits axial movement of an outer piston in a piston assembly that includes an inner piston; and in a second position, permit concurrent axial movement of the outer piston and the inner piston.

In yet another aspect, a multi-speed hydraulic motor is provided that comprise a swash plate with a fixed tilt angle; a plurality of piston assemblies configured to rotate about a drive shaft; wherein each of the plurality of piston assemblies includes: an inner piston slideably coupled to an outer piston that mates with a cylinder in a cylinder block; and a hydraulic retainer device delimiting the axial displacement of the outer piston to in a reduced displacement configuration and permitting full axial displacement of the outer piston in a full displacement configuration.

In any of the aspects or combinations of the aspects, the tilt angle may be fixed.

In any of the aspects or combinations of the aspects, the retainer device may include a pin.

In any of the aspects or combinations of the aspects, the pin may be radially aligned.

In any of the aspects or combinations of the aspects, the hydraulic motor may further comprise a hydraulic line in fluidic communication with the retainer device.

In any of the aspects or combinations of the aspects, the hydraulic line may extend through a housing.

In any of the aspects or combinations of the aspects, the hydraulic line may extend through a valve plate.

In any of the aspects or combinations of the aspects, the retainer device may include an axially displaceable body that includes a radial extension that axially delimits the outer piston in a retracted position.

In any of the aspects or combinations of the aspects, the hydraulic motor may further comprise a controller including instructions that when executed cause the controller to: transition the retainer device between the first position and the second position.

In any of the aspects or combinations of the aspects, the controller may be a transmission control unit in a hydromechanical transmission.

In any of the aspects or combinations of the aspects, selectively adjusting the displacement of the variable displacement hydraulic motor may include during a second operating condition, moving or sustaining the hydraulic retainer device into the second position.

In any of the aspects or combinations of the aspects, adjustment of the hydraulic retainer device may include augmenting a pressure of a hydraulic fluid in a hydraulic line coupled to the hydraulic retainer device to transition the hydraulic retainer device between the first and second positions.

In any of the aspects or combinations of the aspects, the hydraulic retainer device may include a radially aligned pin that extends and retracts.

In any of the aspects or combinations of the aspects, the inner piston may be coupled to a slipper that is in face sharing contact with the swash plate.

In any of the aspects or combinations of the aspects, the hydraulic motor may further comprise a hydraulic line routed through a housing or a valve plate and coupled to the hydraulic retainer device.

In any of the aspects or combinations of the aspects, the multi-speed hydraulic motor may be a two-speed hydraulic motor.

In any of the aspects or combinations of the aspects, the inner and outer pistons may be constructed out of nitride steel.

In another representation, a two-speed hydraulic machine is provided that comprises adjustable volume pistons that re disposed in a cylinder block and designed to alter the displacement of the hydraulic machine.

Note that the example control and estimation routines included herein can be used with various system (e.g., transmission) configurations. The control methods and routines disclosed herein may be stored as executable instructions in non-transitory memory and may be carried out by the control system including the controller in combination with the various sensors, actuators, and other system hardware in combination with the electronic controller. As such, the described actions, operations, and/or functions may graphically represent code to be programmed into non-transitory memory of the computer readable storage medium in the vehicle and/or powertrain control system. The various actions, operations, and/or functions illustrated may be performed in the sequence illustrated, in parallel, or in some cases omitted. Likewise, the order of processing is not necessarily required to achieve the features and advantages of the examples described herein, but is provided for ease of illustration and description. One or more of the illustrated actions, operations and/or functions may be repeatedly performed depending on the particular strategy being used. One or more of the method steps described herein may be omitted if desired.

While various embodiments have been described above, it should be understood that they have been presented by way of example, and not limitation. It will be apparent to persons skilled in the relevant arts that the disclosed subject matter may be embodied in other specific forms without departing from the spirit of the subject matter. The embodiments described above are therefore to be considered in all respects as illustrative, not restrictive. As such, the configurations and routines disclosed herein are exemplary in nature, and that these specific examples are not to be considered in a limiting sense, because numerous variations are possible. For example, the above technology can be applied to powertrains that include different types of propulsion sources including different types of traction motors, internal combustion engines, transmissions, as well as other non-vehicle systems. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A variable displacement hydraulic motor, comprising:
- a swash plate with a tilt angle; and
- a plurality of piston assemblies configured to rotate about a drive shaft;
- wherein each of the plurality of piston assemblies includes:
  - an inner piston slideably coupled to an outer piston that mates with a cylinder in a cylinder block; and
  - a retainer device positioned within the cylinder block and configured to inhibit axial movement of the outer piston in a first position and permit axial movement of the outer piston in a second position;
- wherein the cylinder block rotates about the drive shaft;
- wherein each of the retainer devices includes a pin that is radially aligned with regard to a rotational axis of the drive shaft; and
- wherein each of the retainer devices includes an actuation chamber that is hydraulically coupled to a hydraulic line.

2. The variable displacement hydraulic motor of claim 1, wherein the tilt angle is fixed.

3. The variable displacement hydraulic motor of claim 1, wherein each of the retainer devices includes a spring that mates with the pin.

4. The variable displacement hydraulic motor of claim 1, wherein the hydraulic line is internally routed through the cylinder block.

5. The variable displacement hydraulic motor of claim 1, wherein the hydraulic line is routed through a housing that encloses the cylinder block.

6. The variable displacement hydraulic motor of claim 5, wherein the hydraulic line extends through a housing.

7. The variable displacement hydraulic motor of claim 5, wherein the hydraulic line extends through a valve plate.

8. The variable displacement hydraulic motor of claim 1, wherein the retainer device includes an axially displaceable body that includes a radial extension that axially delimits the outer piston in a retracted position.

9. The variable displacement hydraulic motor of claim 1, wherein the inner and outer pistons are constructed out of nitride steel.

10. The variable displacement hydraulic motor of claim 1, further comprising a controller including instructions that when executed cause the controller to:

transition the retainer device between the first position and the second position.

11. The variable displacement hydraulic motor of claim 10, wherein the controller is a transmission control unit in a hydromechanical transmission.

12. A method for operation of a variable displacement hydraulic motor, comprising:

selectively adjusting a displacement of the variable displacement hydraulic motor via adjustment of multiple hydraulic retainer devices;

wherein each of the multiple hydraulic retainer devices are configured to:

in a first position, delimits axial movement of an outer piston in a piston assembly that includes an inner piston, wherein the inner piston and the outer piston are included in a cylinder block; and in a second position, permit concurrent axial movement of the outer piston and the inner piston;

wherein the multiple hydraulic retainer devices are positioned within the cylinder block;

wherein the multiple piston assemblies rotate about a drive shaft;

wherein the cylinder block rotates about the drive shaft;

wherein each of the multiple hydraulic retainer devices includes a pin that is radially aligned with regard to a rotational axis of the drive shaft; and wherein each of the hydraulic retainer devices include an actuation chamber that is hydraulically coupled to a hydraulic line.

13. The method of claim 12, wherein selectively adjusting the displacement of the variable displacement hydraulic motor includes:

during a first operating condition, moving or sustaining the multiple hydraulic retainer devices into the first position.

14. The method of claim 12, wherein selectively adjusting the displacement of the variable displacement hydraulic motor includes:

during a second operating condition, moving or sustaining the multiple hydraulic retainer devices into the second position.

15. The method of claim 12, wherein adjustment of the multiple hydraulic retainer devices includes augmenting a pressure of a hydraulic fluid in a hydraulic line coupled to the hydraulic retainer device to transition the hydraulic retainer device between the first and second positions.

16. A multi-speed hydraulic motor, comprising:

a swash plate with a fixed tilt angle;

a plurality of piston assemblies configured to rotate about a drive shaft;

wherein each of the plurality of piston assemblies includes:

an inner piston slideably coupled to an outer piston that mates with a cylinder in a cylinder block; and a hydraulic retainer device delimiting the axial displacement of the outer piston in a reduced displacement configuration and permitting full axial displacement of the outer piston in a full displacement configuration;

wherein each of the hydraulic retainer devices are positioned within the cylinder block;

wherein the cylinder block rotates about the drive shaft;

wherein each of the retainer devices includes a pin that is radially aligned with regard to a rotational axis of the drive shaft; and wherein each of the retainer devices includes an actuation chamber that is hydraulically coupled to a hydraulic line.

17. The multi-speed hydraulic motor of claim 16, wherein the hydraulic line is internally routed through the cylinder block.

18. The multi-speed hydraulic motor of claim 16, wherein the inner piston is coupled to a slipper that is in face sharing contact with the swash plate.

19. The multi-speed hydraulic motor of claim 16, wherein the hydraulic line is routed through a housing that encloses the cylinder block.

20. The multi-speed hydraulic motor of claim 16, wherein the multi-speed hydraulic motor is a two-speed hydraulic motor.

* * * * *